United States Patent [19]

Fuse et al.

[11] Patent Number: 4,878,047

[45] Date of Patent: Oct. 31, 1989

[54] STRUCTURE OF MULTIPLEX-TYPE LIQUID CRYSTAL IMAGE DISPLAY APPARATUS, AND CONTROL CIRCUIT THEREFOR

[75] Inventors: Takahiro Fuse; Koji Yamagishi, both of Tokyo, Japan

[73] Assignee: Casio Computer Co., Ltd., Tokyo, Japan

[21] Appl. No.: 111,686

[22] Filed: Oct. 16, 1987

[30] Foreign Application Priority Data

Oct. 21, 1986 [JP] Japan ..... 61-160049[U]
Oct. 24, 1986 [JP] Japan ..... 61-163256[U]

[51] Int. Cl.[4] ..... G09G 3/36

[52] U.S. Cl. ..... 340/784; 340/703; 358/241; 358/236

[58] Field of Search ..... 340/784, 703, 802; 358/236, 241; 341/155

[56] References Cited

U.S. PATENT DOCUMENTS 3,862,360 1/1975 Dill et al. ..... 340/784
4,393,380 7/1983 Hosokawa et al. ..... 340/784
4,499,459 2/1985 Sasaki et al. ..... 340/784
4,562,478 12/1985 Hirasawa et al. .
4,582,395 4/1986 Morozumi .
4,600,274 7/1986 Morozumi ..... 340/784
4,602,292 7/1986 Togashi et al. ..... 358/236
4,630,122 12/1986 Morokawa .
4,646,158 2/1987 Ohno et al. ..... 358/236
4,745,485 5/1988 Iwasaki et al. ..... 340/784

FOREIGN PATENT DOCUMENTS 2543341 3/1984 France .
60-120677 6/1985 Japan .
60-120678 6/1985 Japan .
62-271570 11/1987 Japan .

*Primary Examiner*—Donald J. Yusko
*Assistant Examiner*—Edwin C. Holloway, III
*Attorney, Agent, or Firm*—Frishauf, Holtz, Goodman & Woodward

[57] ABSTRACT

An image display apparatus in which segment electrodes of a liquid crystal panel are extracted or accessed upward and downward alternately one by one, relative to the panel. A luminance signal is alternately A/D-converted by two A/D converters, and the segment electrodes extracted upward and downward are respectively driven in accordance with A/D-converted outputs from the two A/D converters.

27 Claims, 12 Drawing Sheets

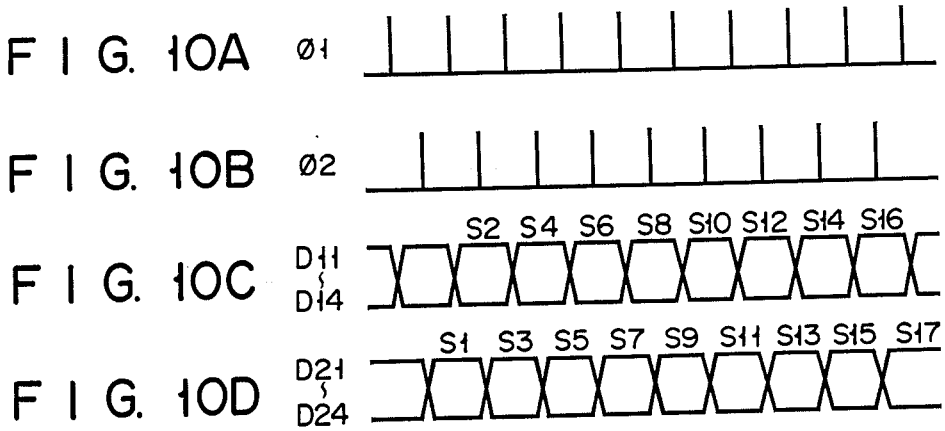
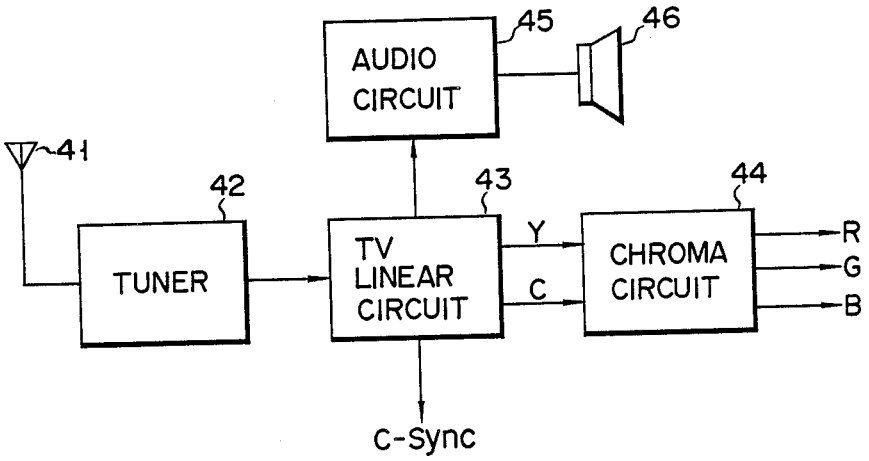
FIG. 11

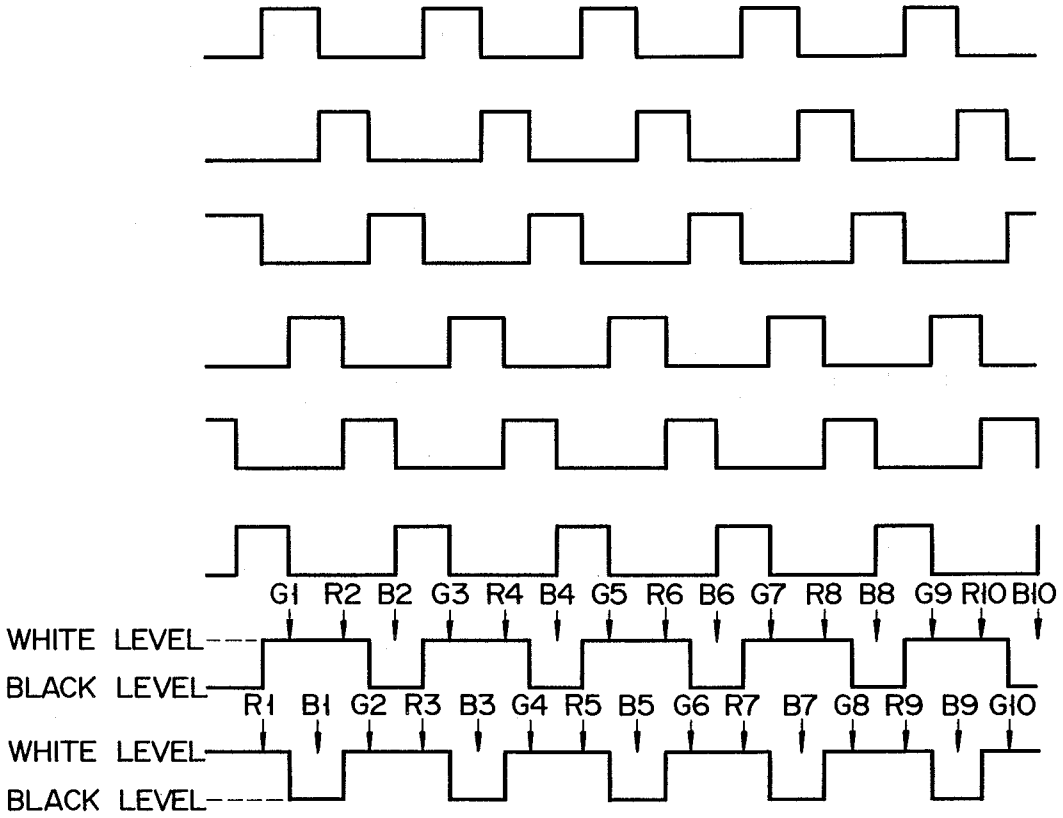
FIG. 16F AN1
FIG. 16G AN2
FIG. 16H AN3
FIG. 16I AN4
FIG. 16J AN5
FIG. 16K AN6
FIG. 16L AD1
FIG. 16M AD2

STRUCTURE OF MULTIPLEX-TYPE LIQUID CRYSTAL IMAGE DISPLAY APPARATUS, AND CONTROL CIRCUIT THEREFOR

BACKGROUND OF THE INVENTION

The present invention relates to an image display apparatus used in a liquid crystal television set.

Known examples of a liquid crystal television set are the active matrix type and the multiplex type. Since the duty ratio of the active matrix type liquid crystal television set is substantially 100%, there is less degradation of image quality if the number of pixels is increased. On the other hand, it is difficult to manufacture this type of television set, which results in a poor yield. Examples of the active matrix type liquid crystal television are disclosed in U.S. Pat. Nos. 4,393,380 and 4,582,395.

In contrast, the multiplex type liquid crystal television set is relatively easy to manufacture and thus is well-suited for mass production. However, since this type of set uses an A/D converter, then in order to increase the number of pixels, it is necessary to provide an A/D converter which can operate at high speed.

As is shown in FIG. 1, a conventional image display apparatus used in a multiplex type liquid crystal television set comprises A/D converter 1 for converting luminance signal Y, supplied from an image amplifier (not shown), into, for example, four bit data D1 through D4, segment driver 2 for driving segment electrodes of liquid crystal display panel 5, shown in FIG. 2, in accordance with data D1 through D4, common driver 3 for sequentially driving the common electrodes of panel 5, and timing controller 4 for supplying a variety of timing signals to A/D converter 1 and drivers 2 and 3. In panel 5 shown in FIG. 2, all the segment electrodes are extracted or accessed from one side, e.g., the upper side of the panel. Note that FIG. 1 shows a case wherein panel 5 consisting of 112×288 dots as shown in FIG. 2 is to be driven.

According to the above conventional method, assuming that an effective period of one scanning line is T (sec) and the number of horizontal pixels is n, a sampling frequency of A/D converter 1 and a data transfer frequency fs of driver 2 are represented by:

$$fs = n/T \text{ (Hz)}$$

Therefore, if the number of pixels is increased to improve horizontal resulution, frequency fs is increased in proportion thereto. For this reason, the following problems arise:

(1) A/D converter 1, which can operate at high speed, and driver 2 are expensive and power-consuming.

(2) As the speed of A/D converter 1 is increased, the harmonic component of the digital signal has a high frequency, and thereby interferes with the television receiver.

As shown in FIG. 3, an image display apparatus in a conventional liquid crystal color television set comprises A/D converters 11, 13, and 15 for respectively A/D-converting the primary color signals of R, G, and B supplied from a chroma circuit (not shown), segment drivers 12, 14, and 16 for driving the segment electrodes of color liquid crystal panel 19, shown in FIG. 4, in accordance with output signals from A/D converters 11, 13, and 15, respectively common driver 17 for sequentially driving the common electrodes of panel 19, and timing controller 18 for supplying a variety of timing signals to A/D converters 11, 13, and 15 and drivers 12, 14, 16, and 17. In panel 19, shown in FIG. 4, the segment electrodes of R (red) and G (green) are extracted from one side, e.g., the upper side of the panel, and the segment electrodes of B (blue) are extracted from the lower side thereof. Note that FIG. 3 shows a case wherein panel 19 consisting of 112×144×3 dots, as shown in FIG. 4, is to be driven.

In the above arrangement, signal R of red is A/D-converted into, e.g., four bit data DR1 through DR4, by A/D converter 11 and supplied to driver 12. Driver 12 outputs data of one scanning line, as a liquid crystal drive signal, to segment electrodes R1 through R144 of panel 19. Similarly, signals G and B of green and blue are A/D-converted by A/D converters 13 and 15, and then output from drivers 14 and 16 to segment electrodes G1 through G144 and B1 through B144 of panel 19, respectively. In this case, three pairs of A/D converters 11, 13, and 15 and drivers 12, 14, and 16 are controlled to operate at the same timing by controller 18. Common electrodes C1 through C112 of panel 19 are sequentially driven by driver 17. By the above series of operations, a color image is displayed on panel 19.

According to the above conventional method, since three A/D converters are required, this increases the manufacturing cost and power consumption of the apparatus. Moreover, since two arrays of segment electrodes (electrodes of R and G in FIG. 4) are extracted from panel 19 in the same direction, these electrodes are connected to the segment drivers in a staggered manner, resulting in poor productivity.

SUMMARY OF THE INVENTION

The present invention has been developed in consideration of the above situation and has as its object to provide an image display apparatus in which an A/D converter can be constituted at low cost, its power consumption can be reduced, horizontal resolution can be improved without increasing the sampling frequency of the A/D converter and the data transfer frequency of the segment driver, and in the case of a color image display apparatus, the segment electrodes of the color liquid crystal panel can be easily connected to the segment driver.

In order to achieve the above object, an image display apparatus is provided which comprises a liquid crystal display panel in which odd-numbered segment electrodes and even-numbered segment electrodes are extracted from different sides, i.e., from the upper side and from the lower side, respectively, a first A/D converter for converting a luminance signal, to be displayed on the liquid crystal display panel, into digital data, a second A/D converter for converting the luminance signal into digital data at a timing having a phase different from that of the first A/D converter, a first segment driver for driving the odd- or even-numbered segment electrodes of the liquid crystal display panel, in accordance with an output signal from the first A/D converter, a second segment driver for driving the segment electrodes other than those driven by the first segment driver, in accordance with an output signal from the second A/D converter, and a common driver for sequentially driving common electrodes of the liquid crystal display panel.

With the above arrangement, the sampling frequency of the A/D converter and the data transfer frequency of the segment driver can be reduced. Therefore, even if horizontal resulution is doubled, a conventional operation frequency can be used, the A/D converter can be constituted at low cost, and interference with respect to the television receiver, caused by digital data, can be prevented.

Moreover, as regards a color image display apparatus, the above object can be achieved by the use of only two A/D converters. Therefore, the cost and the power consumption of the A/D converters can be reduced. In addition, since the segment electrodes of the color liquid crystal panel are extracted upward and downward at every other position, this enables them to be more easily connected to the segment driver, thereby improving productivity.

BRIEF DESCRIPTION OF THE DRAWINGS

FIGS. 10A through 10D are timing charts for explaining the operation of the first embodiment of the present invention, respectively;

FIG. 11 is a block diagram of an arrangement of a color television receiver according to a second embodiment of the present invention;

FIGS. 16A through 16M are timing charts for explaining an operation of the second embodiment of the present invention.

DETAILED DESCRIPTION OF THE PREFERRED EMBODIMENTS

Figure 1:
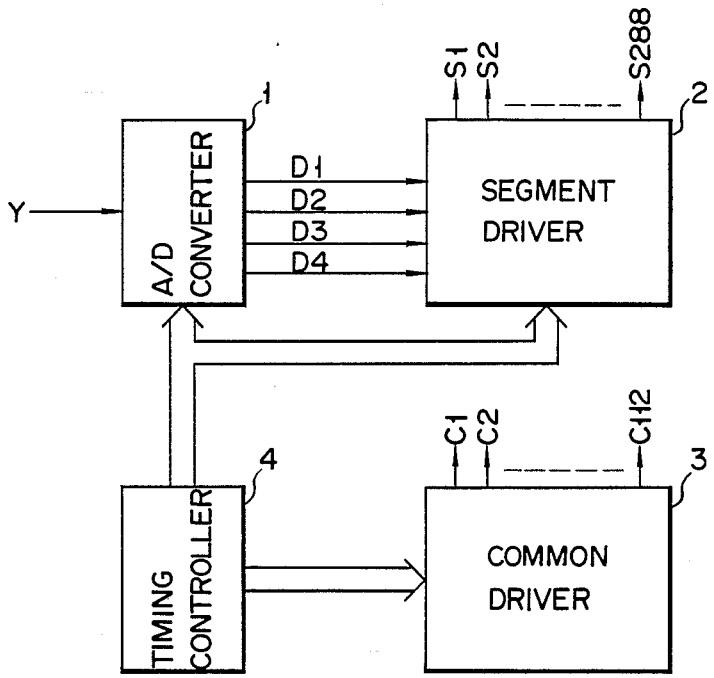
F I G. 1 (PRIOR ART)
FIG. 1 is a block diagram of a circuit arrangement of a conventional image display apparatus.
Figure 2:
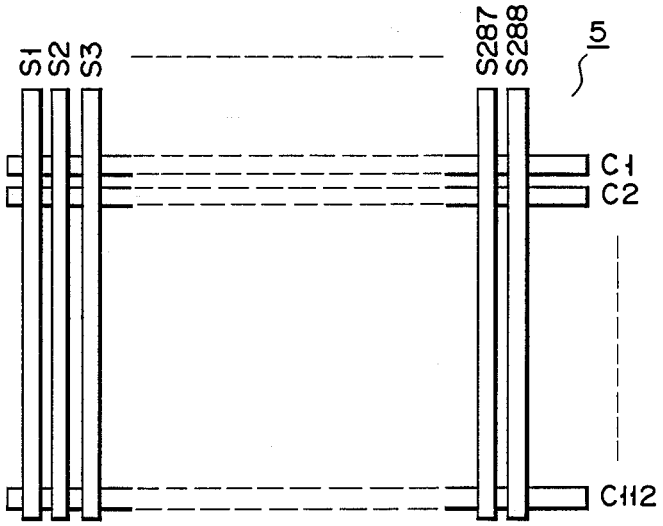
F I G. 2 (PRIOR ART)
FIG. 2 is a schematic view of an electrode structure of a conventional liquid crystal display panel.
Figure 3:
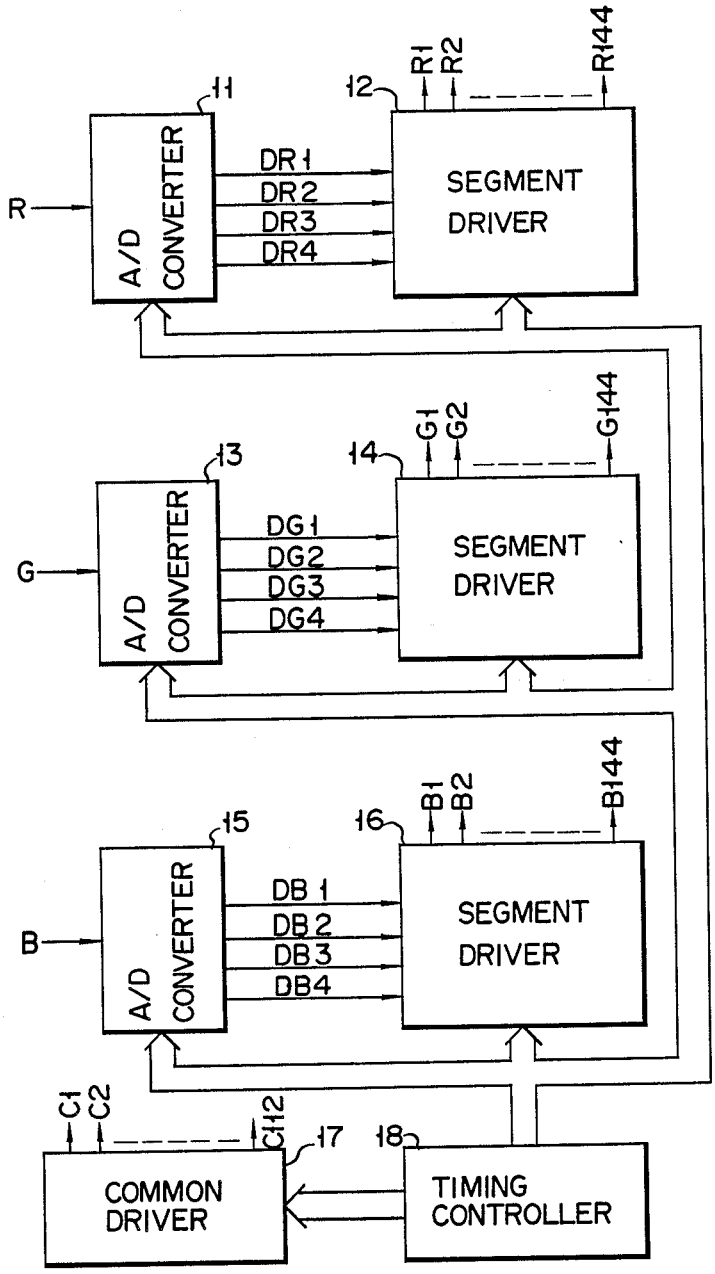
FIG. 3 (PRIOR ART)
FIG. 3 is a block diagram of a circuit arrangement of a conventional color image display apparatus.
Figure 4:
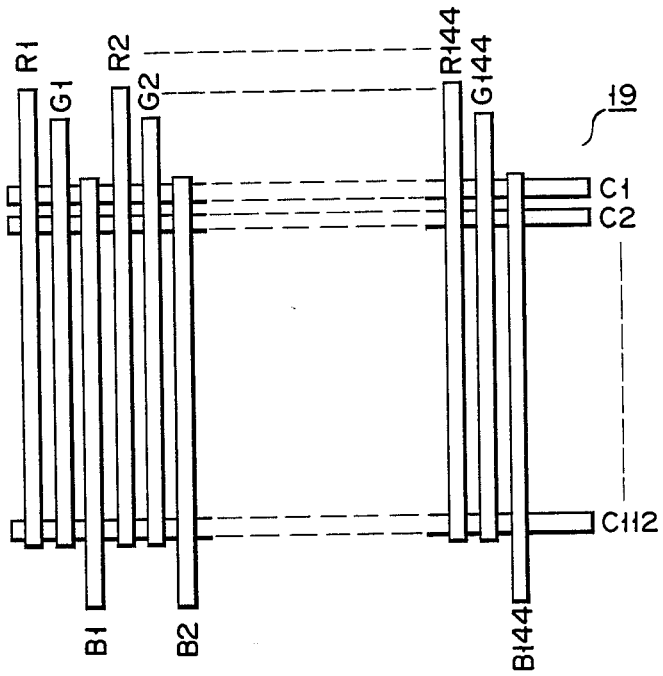
F I G. 4 (PRIOR ART)
FIG. 4 is a schematic view of an electrode structure of a conventional color liquid crystal display panel.
Figure 5:
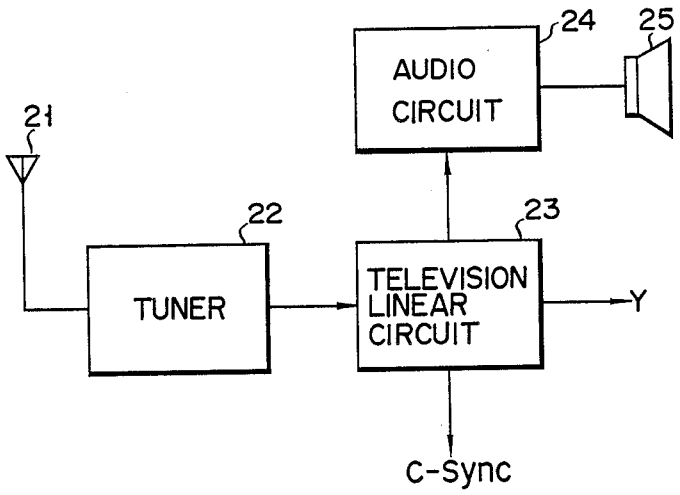
FIG. 5 is a block diagram of an arrangement of a television receiver according to a first embodiment of the present invention.

A first embodiment of the present invention will now be described below, with reference to the accompanying drawings. FIG. 5 is a block diagram of an arrangement of a television receiver. In FIG. 5, a radio wave received by antenna 21 is tuned by tuner 22, and luminance signal Y and composite sync signal C-Sync are output through television linear circuit 23 which includes an intermediate frequency amplifier, a video detector, a video amplifier, and the like. An audio signal is detected and amplified by audio circuit 24 and is generated from loudspeaker 25.

Figure 6:
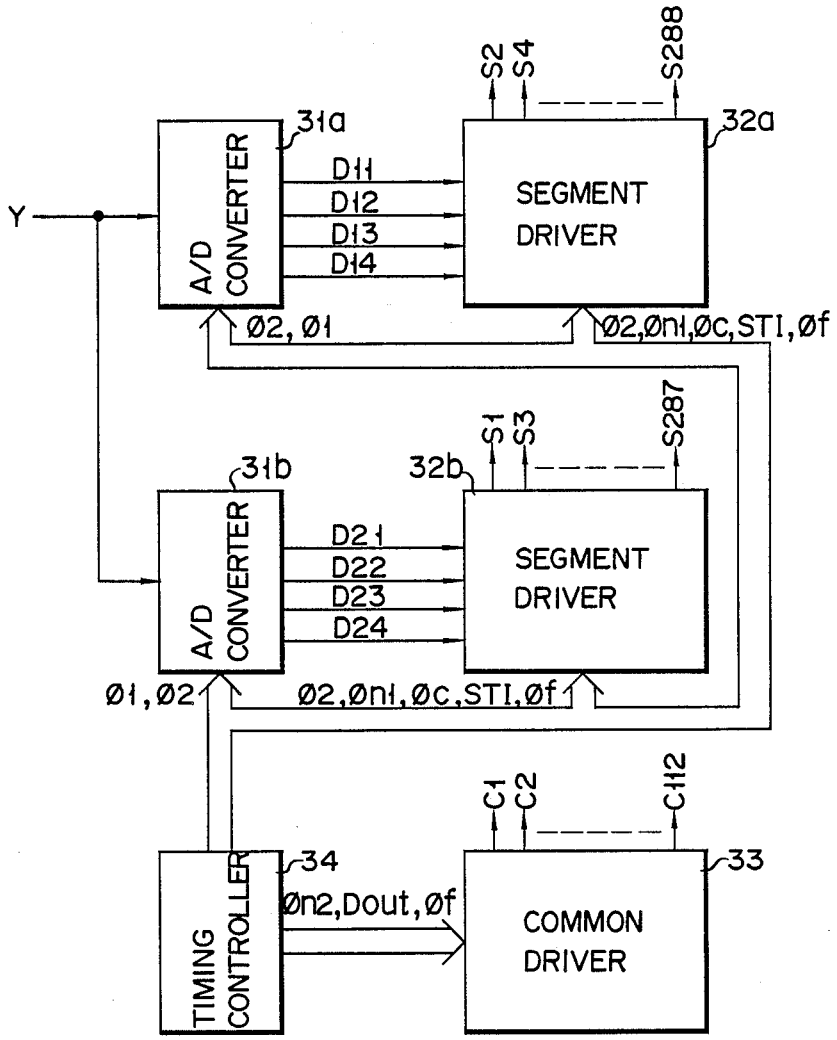
FIG. 6 is a block diagram of an arrangement of an image display apparatus according to the first embodiment of the present invention.
Figure 7:
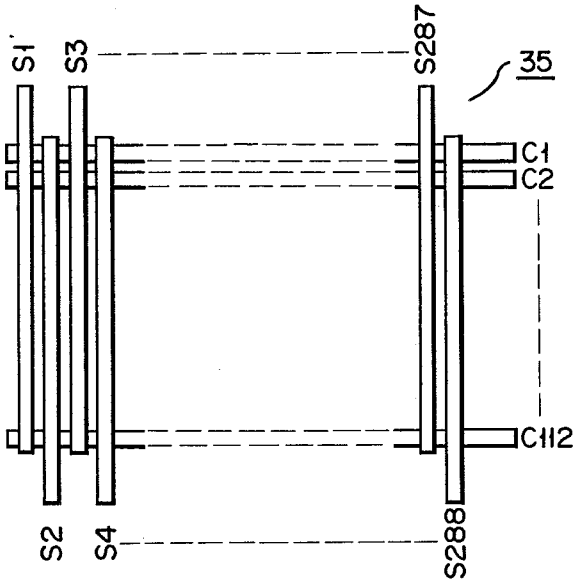
FIG. 7 is a schematic view of an electrode structure of a liquid crystal display panel of the first embodiment of the present invention.

FIG. 6 is a block diagram of an image display apparatus for displaying a television image received by the above television receiver. As is shown in FIG. 6, the image display apparatus comprises: first A/D converter 31*a* for converting signal Y supplied from circuit 23 of FIG. 5 into, for example, four bit data D11, D12, D13, and D14; second A/D converter 31*b* for converting signal Y into four bit data D21, D22, D23, and D24, at a timing different from that of converter 31*a*; first segment driver 32*a* for driving even-numbered segment electrodes S2, S4, . . . , S288 of liquid crystal display panel 35 consisting of, for example, 112×288 dots, as is shown in FIG. 7, in accordance with data D11 through D14 from A/D converter 31*a*; second segment driver 32*b* for driving odd-numbered segment electrodes S1, S3, . . . , S287 of panel 35, in accordance with data D21 through D24 from A/D converter 31*b*; common driver 33 for sequentially driving common electrodes C1 through C112 of panel 35; and timing controller 34 for controlling the operation timings of these circuits. Controller 34 supplies clock pulse $\phi 1$, shown in FIGS. 9B and 10A, to A/D converter 31*a*, and supplies clock pulse $\phi 2$, whose phase is shifted 180° from that of pulse $\phi 1$, to A/D converter 31*b*, respectively, as sampling clocks. As a result, data D11 through D14 and data D21 through D24 are output having a 180° phase difference, i.e., output alternately from A/D converters 31*a* and 31*b*, respectively.

Panel 35 shown in FIG. 7 has electrodes consisting of, for example, 112×288 dots. In this case, odd-numbered electrodes S1, S3, . . . , S287 are extracted from the upper side of the panel and even-numbered electrodes S2, S4, . . . , S288 are extracted from the lower side thereof.

Figure 8:
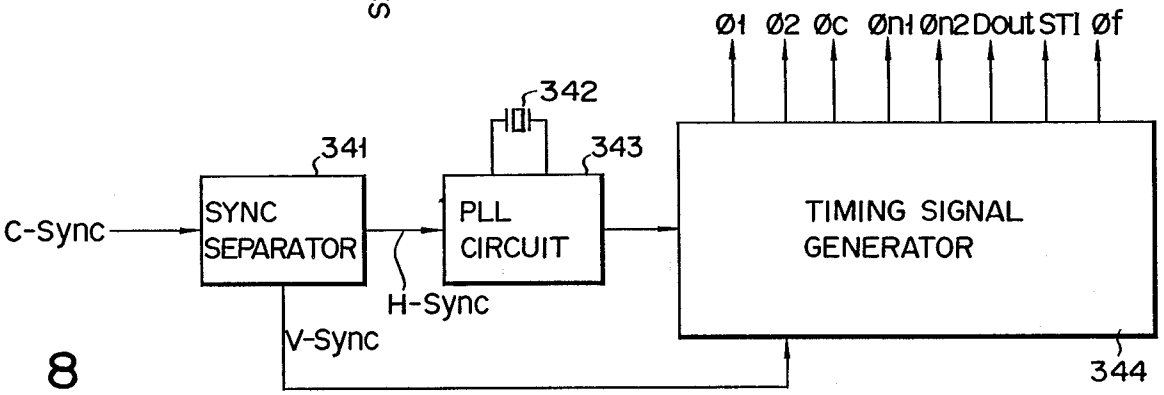
FIG. 8 is a block diagram of an arrangement of a timing controller of FIG. 7.

An arrangement of controller 34 will now be described below, with reference to FIG. 8. Signal C-Sync output from circuit 23 is input to sync separator 341 and therein is separated into vertical sync signal V-Sync and horizontal sync signal H-Sync. Signal H-Sync is input to PLL circuit 343, which includes oscillator 342. PLL circuit 343 locks a phase of an oscillation frequency signal from oscillator 342 to that of signal H-Sync, and supplies a stable frequency signal to timing signal generator 344. Generator 344 divides the input frequency signal, as required, and generates and outputs various timing signals.

Figures 9A, 9B, 9C, 9D, 9E, 9F, 9G, 9H, 9I, 9J, 9K:
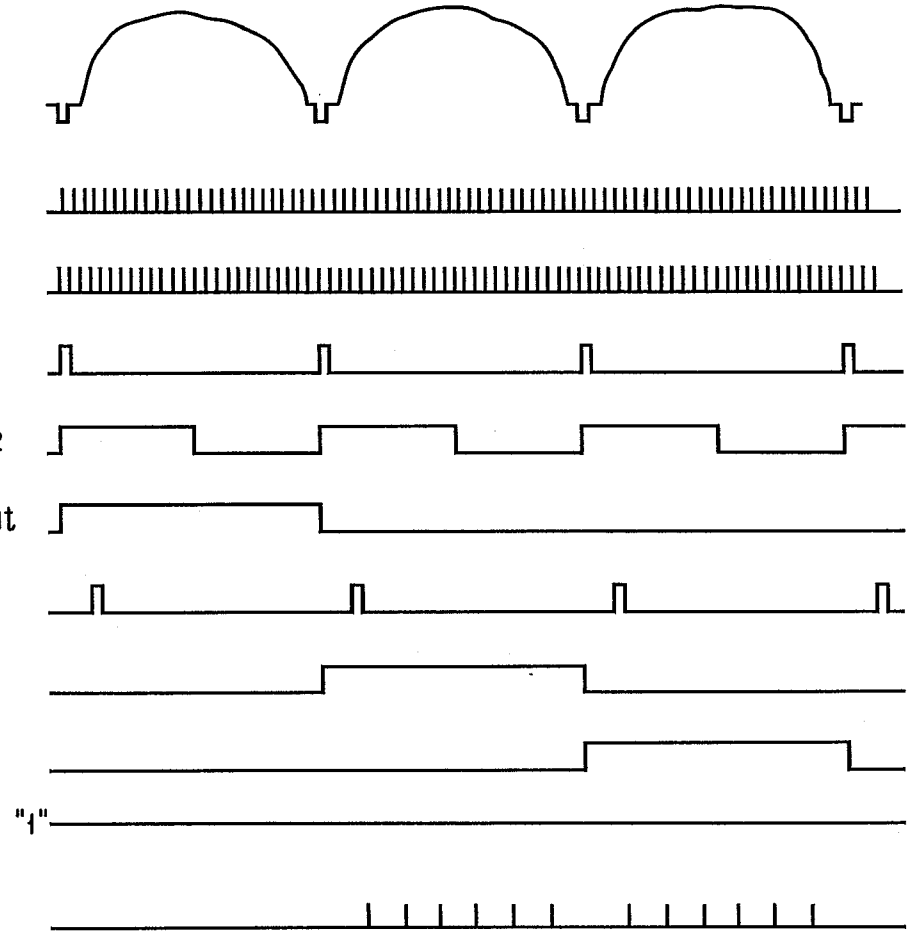
FIGS. 9A through 9K are timing charts for explaining timing signals, respectively.

These timing signals will now be described in detail, with reference to FIGS. 9A through 9K. Pulses $\phi 1$ and $\phi 2$, shown in FIGS. 9B and 9C, respectively, are clock pulses whose phases are shifted 180° from each other. Pulse $\phi 2$ is supplied to A/D converter 31*a*, as a sampling clock, and pulse $\phi 1$ is supplied thereto, as an output clock, respectively. Pulse $\phi 1$ is supplied to A/D converter 31*b*, as a sampling clock, and pulse $\phi 2$ is supplied thereto, as an output clock, respectively. FIGS. 9B and 9C show only small numbers of pulses $\phi 1$ and $\phi 2$ produced during a period of one H-sync signal. However, pulses $\phi 1$ and $\phi 2$ are actually output by the number half that of a sampling number during the period of one H-sync signal (144 in this embodiment). Pulse $\phi 2$ is also supplied to drivers 32*a* and 32*b*. STI represents a shift data signal supplied to drivers 32*a* and 32*b*. Data D11 through D14 and data D21 through D24 are fetched while signal STI is shifted by pulse $\phi 2$. After digital data of one line (1 H) is fetched, the data is latched in buffers (not shown) of drivers 32*a* and 32*b* by clock pulse $\phi$nl, shown in FIG. 9D. Then, gradation signals are generated by gradation signal generation clock pulse $\phi$c, shown in FIG. 9*k*. The gradation signals are supplied from driver 32*a* to electrodes S2 through S288, and supplied from driver 32*b* to electrodes S1 through S287, respectively. Arrangements and operations of drivers 32*a* and 32*b* are described in detail in U.S. Ser. No. 907,679. Dout, shown in FIG. 9F, represents a shift data signal to be supplied to driver 33. Signals Dout are output one by one in units of fields, sequentially shifted by timing signal $\phi$n2, shown in FIG. 9E, and then supplied to electrodes C1 through C112. Symbol $\phi$f, shown in FIG. 9J, represents a frame signal for AC-driving a liquid crystal. Signal $\phi$f is inverted in units of fields. That is, signal $\phi$f is at level "1" in a field shown in FIG. 9J and goes to level "0" in the next field. The level of a signal to be supplied to the segment and common electrodes is inverted in accordance with signal $\phi$f, thereby AC-driving the liquid crystal.

In the above arrangement, as shown in FIGS. 10A through 10D, when signal Y is supplied from circuit 23, A/D converter 31*a* samples signal Y by pulse $\phi$2. A/D converter 31*a* converts signal Y into data D11 through D14, and outputs them to driver 32*a* by pulse $\phi$1. A/D converter 31*b* samples signal Y by pulse $\phi$1, converts signal Y into data D21 to D24, and outputs them to driver 32*b* by pulse $\phi$2, as shown in FIG. 10. Therefore, driver 32*a* sequentially reads data D11 through D14 supplied from A/D converter 31*a*. When data of one line (as a data amount, a ½ line) are supplied, driver 32*a* drives even-numbered electrodes S2, S4, . . . , S288 of panel 35 in accordance with data contents. Driver 32*b* sequentially reads data D21 through D24 supplied from A/D converter 31*b* in a phase shifted 180° from that of driver 32*a*. When data of one line (as a data amount, a ½ line) are supplied, driver 32*b* drives odd-numbered electrode S1, S3, . . . , S287 of panel 35 in accordance with data contents. As described above, the odd-numbered electrodes whose terminals are extracted upward from panel 35 and the even-numbered electrodes whose terminals are extracted downward therefrom are simultaneously driven by drivers 32*a* and 32*b*. Therefore, all of electrodes S1, S2, . . . , S288 of one line can be driven at the same time. Driver 33 starts scanning of the common electrodes in synchronism with signal Dout synchronized with the vertical sync signal and sequentially drives electrodes C1 through C112 selectively at predetermined timings. By driving the elctrodes by drivers 32*a*, 32*b*, and 33, an image corresponding to signal Y is displayed on panel 35.

As described above, since A/D converts 31*a* and 31*b* alternately A/D-convert the video signals supplied from the video amplifier and output them to drivers 32*a* and 32*b*, an operation frequency can be reduced half that required when video signals are sequentially A/D-converted by a single A/D converter.

Note that in the above embodiment, driver 32*a* drives the even-numbered segment electrodes of panel 35, and driver 32*b* drives the odd-numbered segment electrodes thereof, respectively. However, the odd-numbered electrodes may be driven by driver 32*a*, and the even-numbered electrodes may be driven by driver 32*b*.

A second embodiment of the present invention will be described below. FIG. 11 is a block diagram of a receiver of a color television circuit. In FIG. 11, a radio wave received by antenna 41 is turned by tuner 42, and luminance signal Y, color television signal C, and composite sync signal C-Sync are output through television linear circuit 43 which includes an intermediate frequency amplifier, a video detector, and a video amplifier. Signals Y and C are input to chroma circuit 44, and primary color signals R, G, and B are output therefrom. An audio signal is detected and amplified by audio circuit 45 which includes an audio detector, an audio amplifier, and the like, and a sound is generated from loudspeaker 46.

Figure 12:
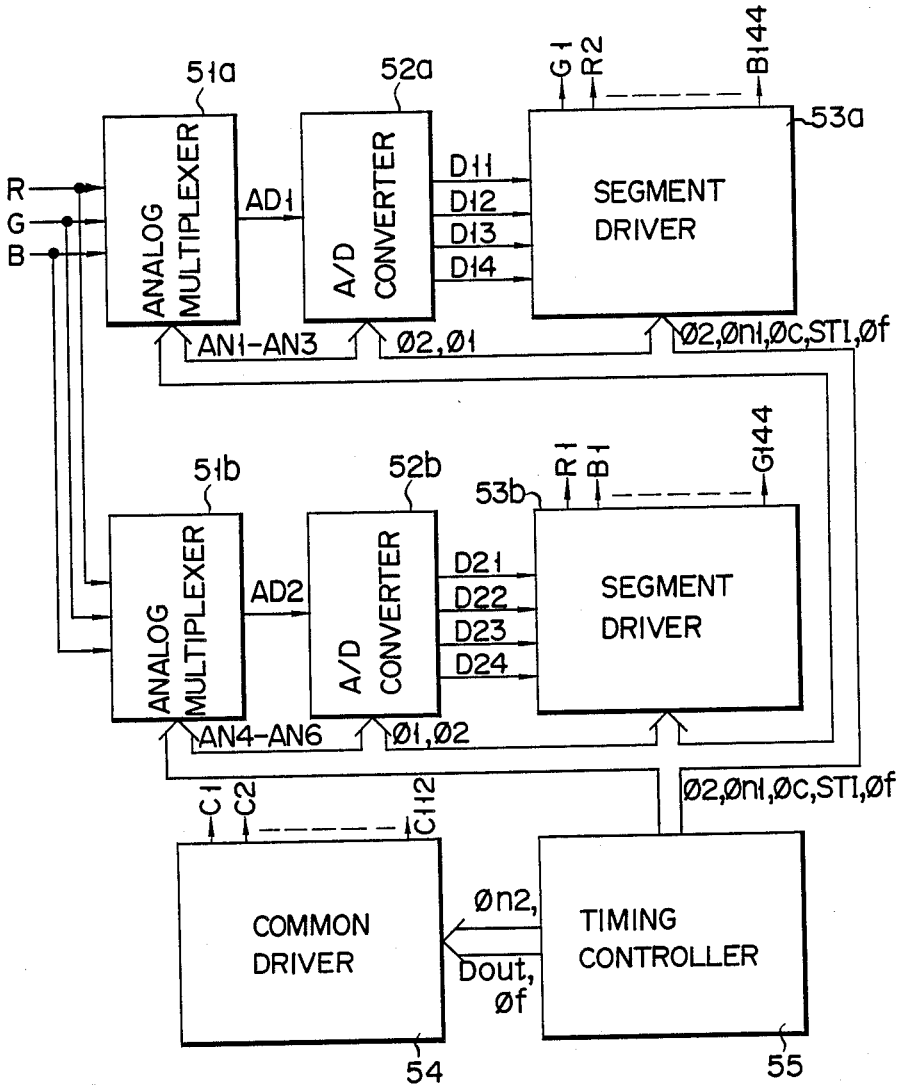
FIG. 12 is a block diagram of an arrangment of a color image display apparatus according to the second embodiment of the present invention.
Figure 13:
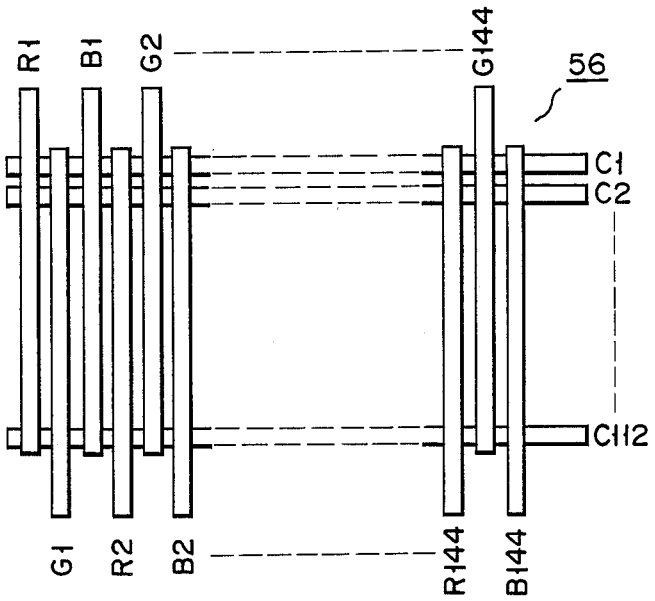
FIG. 13 is a schematic view of an electrode structure of a color liquid crystal display panel of the second embodiment.

FIG. 12 is a block diagram of an image display apparatus for displaying a television image received by the above color television receiver. As shown in FIG. 12, signals R, G, and B supplied from circuit 44 are input to first analog multiplexer 51*a* and second analog multiplexer 51*b*. Multiplexer 51*a* time-divisionally mixes signals R, G, and B in a predetermined order and outputs mixed signal AD1 to first A/D converter 52*a*. Multiplexer 51*b* time-divisionally mixes signals R, G, and B at a timing different from that of multiplexer 51*a* and outputs mixed signal AD2 to second A/D converter 52*b*. A/D converters 52*a* and 52*b* convert signals AD1 and AD2 into, e.g., four bit data D11 through D14 and D21 at different timings and output them to first and second segment drivers 53*a* and 53*b*, respectively. Driver 53*a* drives even-numbered segment electrodes G1, R2, . . . , B144 extending downward from color liquid crystal panel 56 of, e.g., 112×144×3 dots as shown in FIG. 13 in accordance with data D11 through D14 from A/D converter 52*a*. Driver 53*b* drives odd-numbered segment electrodes R1, B1, . . . , G144 extending upward from panel 56 in accordance with data D21 through D24 from A/D converter 52*b*. As described above, panel 56 shown in FIG. 13 has electrodes of, e.g., 112×144×3 dots. In panel 56, odd-numbered electrodes R1, B1, . . . , G144 are extracted upward, and even-numbered electrodes G1, R2, . . . , B144 are extracted downward.

Common electrodes C1 through C112 of panel 56 are sequentially and selectively driven by common driver 54. Operation timings between multiplexers 51*a* and 52*b*, A/D converters 52*a* and 52*b*, and drivers 53*a*, 53*b*, and 54 are controlled by timing controller 55.

Figure 14:
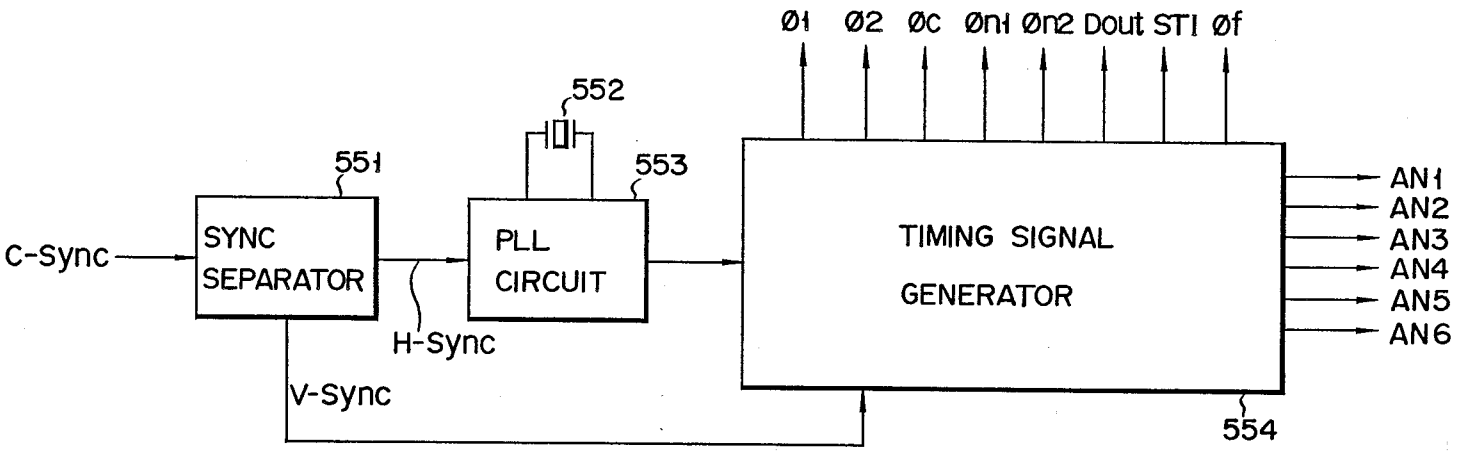
FIG. 14 is a block diagram of an arrangement of a timing controller of FIG. 12.

An arrangement of controller 55 is shown in FIG. 14. A detailed description of controller 55 will be omitted since it has substantially the same arrangement as that of timing controller 34 of the first embodiment shown in FIG. 8 except that timing signal generator 554 generates switch signals AN1 through AN6. Signals AN1 through AN6 are supplied to multiplexers 51*a* and 51*b*, and their timings are shown in FIGS. 16F through 16K.

Figure 15:
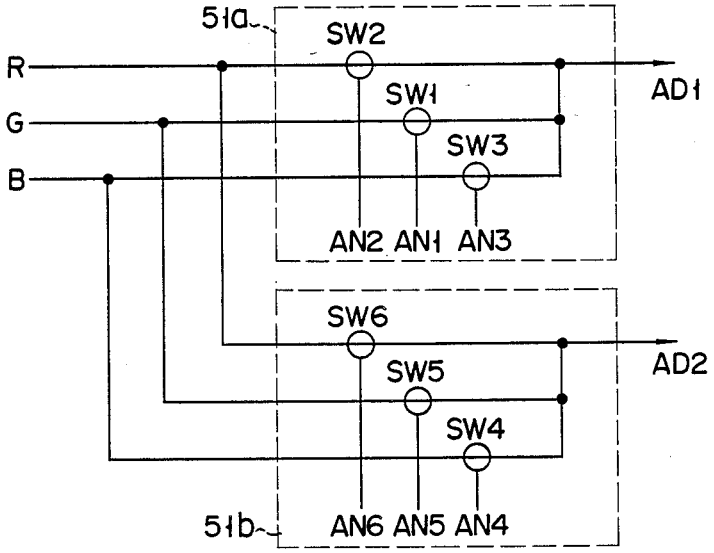
FIG. 15 is a circuit diagram of an arrangement of an analog multiplexer of FIG. 12.

Multiplexers 51*a* and 51*b* will be described in detail with reference to FIG. 15. Multiplexer 51*a* consists of analog switches SW1, SW2, and SW3. Signals G, R, and B are input to switches SW1, SW2, and SW3, respectively. Switches SW1 through SW3 are controlled by signals AN1 through AN3, respectively. Signals received from switches SW1 through SW3 are mixed with each other and supplied to A/D converter 52*a* as mixed signal AD1. Signals AN1 through AN3 are sequentially output from controller 55 with a phase difference of 120° as shown in FIGS. 16F through 16H.

Multiplexer 51*b* consists of analog switches SW4, SW5, and SW6. Signals B, G, and R are input to switches SW4, SW5, and SW6, respectively. Switches SW4 through SW6 are controlled by signals AN4 through AN6, respectively. Signals received from switches SW4 through SW6 are mixed with each other and supplied to A/D converter 52b as mixed signal AD2. Signals AN4 through AN6 are output from controller 55 with a phase difference of 120° with each other and a delay of 60° with respect to signals AN1 through AN3, as shown in FIGS. 16I through 16K.

As operation of the second embodiment will be described below. With signals R, G, and B are supplied from circuit 44, multiplexers 51a and 51b time-divisionally mix signals R, G, and B and output mixed signals AD1 and AD2 to A/D converters 52a and 52b, respectively. That is, when switches SW1 through SW3 are sequentially selected and turned on by signals AN1 through AN3, multiplexer 51a selectively mixes the color signals in the order of G1→R2→B2→G3 . . . as shown in FIG. 16L and outputs signal AD1 to A/D converter 52a. A/D converter 52a samples signal AD1, converts it into four bit data D11 through D14, and outputs them to driver 53a. Driver 53a sequentially reads data D11 through D14 supplied from A/D converter 52a. When data of one line are transferred, driver 53a drives even-numbered electrodes G1, R2, B2, . . . , R144, and B144 extending downward from panel 56 in accordance with data contents.

Figures 16A, 16B, 16C, 16D, 16E:
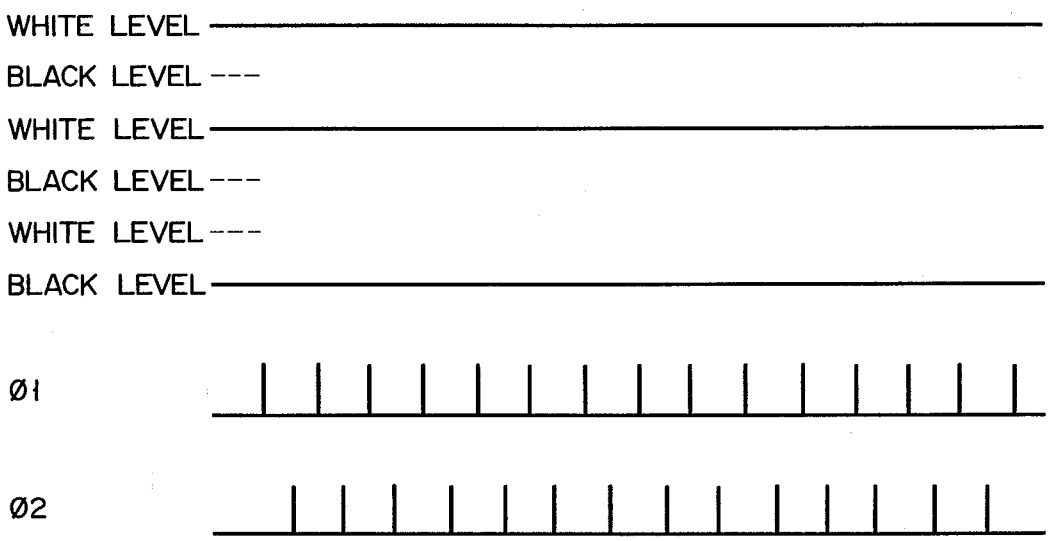

When switches SW4 through SW6 are sequentially selected and turned on by signals AN4 through AN6, multiplexer 51b selectively mixes the color signals in the order of R1 → B1 → G2 → R3 . . . as shown in FIG. 16M and outputs signal AD2 to A/D converter 52b. A/D converter 52b samples signal AD2, converts it into four bit data D21 through D24, and outputs them to driver 53b. Driver 53b sequentially reads data D21 through D24 supplied from A/D converter 52b. When data of one line are transferred, driver 53b drives odd-numbered electrodes R1, B1, G2, . . . , and G144 extending upward from panel 56 in accordance with data contents.

As described above, the odd-numbered electrodes extracted upward from panel 56 and the even-numbered electrodes extracted downward therefrom are simultaneously driven by drivers 53a and 53b. Therefore, all of electrodes R1, G1, B1, R2, G2, B2, . . . , R144, G144, and B144 of one line can be driven at the same time. Driver 54 starts scanning the common electrodes in synchronism with the vertical sync signal and sequentially drives electrodes C1 through C112 selectively at predetermined timings. By driving the electrodes by drivers 53a, 53b, and 54, a color image corresponding to signals R, G, and B is displayed on panel 56.

What is claimed is:

1. An image display apparatus, comprising:

a liquid crystal display panel having segment electrodes and common electrodes, wherein odd-numbered segment electrodes are extracted from one side and different, even-numbered segment electrodes are extracted from a different side of the display panel, each common electrode defining a different scanning line on which the odd-numbered and the even-numbered segment electrodes are alternately arranged to form a corresponding number (n) of pixels when a common electrode is selectively driven a certain time period (T) and the segment electrodes are driven during said time period;

a first A/D converter for converting a luminance signal, to be displayed on said liquid crystal display panel, into digital data at a certain phase timing;

a second A/D converter for converting the luminance signal into digital data at a timing having a phase different from that of said first A/D converter;

a first segment driver for driving the odd segment electrodes of said liquid crystal display panel, in accordance with an output signal from said first A/D converter;

a second segment driver for driving the even segment electrodes, in accordance with an output signal from said second A/D converter; and a common driver for sequentially driving the common electrodes of said liquid crystal display panel;

wherein said first and second A/D converters each include means for operating at a sampling frequency ($f_s$) substantially equal to one-half (n/T).

2. An apparatus according to claim 1, wherein said odd-numbered segment electrodes and said even-numbered segment electrodes are arranged to extend in opposite directions and are connected to said first and second segment drivers, respectively.

3. An apparatus according to claim 1, further comprising a television circuit means for receiving a television signal to drive said color liquid crystal display panel in relation thereto, said first and said second A/D converters include means to A/D convert primary color signals supplied from said television circuit means.

4. An apparatus according to claim 1, wherein said segment electrodes and said common electrodes are arranged in a matrix fashion.

5. An image display apparatus, comprising:

a color liquid crystal panel having segment electrodes and common electrodes, wherein odd-numbered segment electrodes are extracted from an upper side and even-numbered segment electrodes are extracted from a lower side of the display panel, each common electrode defining a different scanning line on which the odd-numbered and the even-numbered segment electrodes are alternately arranged so that successive sets of adjacent segment electrodes along each scanning line form a corresponding number (n) of pixels when a common electrode is selectively driven a certain time period (T) and the sets of segment electrodes are driven during said time period;

first and second analog multiplexers for time-divisionally mixing primary color signals of red (R), green (G) and blue (B) to be displayed on said color liquid crystal panel in an order corresponding to the segment electrodes extracted from the upper side and the lower side of said color liquid crystal panel, respectively;

first and second A/D converters for A/D converting signals which are time-divisionally mixed by said first and said second analog multiplexers, respectively;

first and second segment drivers for driving the segment electrodes extracted from the upper and the lower sides of said color liquid crystal display panel, in accordance with output signals from said first and said second A/D converters, respectively, wherein said segment electrode is always associated with only one of said R, G and B primary color signals; and a common driver for sequentially driving the common electrodes of said color liquid crystal panel;

wherein said first and said second A/D converters each include means for operating at a sampling frequency ($f_s$) substantially equal to one-half (n/T).

6. An apparatus according to claim 5, wherein each said set of segment electrodes are arranged in a sequence of any combination corresponding to R, G, B.

7. An apparatus according to claim 5, wherein said odd-numbered segment electrodes and said even-numbered segment electrodes are arranged to extend in opposite directions and are connected to said first and said second segment drivers, respectively.

8. An apparatus according to claim 5, further comprising a television circuit means for receiving a television signal to drive said color liquid crystal display panel in relation thereto, said first and said second A/D converters include means to A/D convert primary color signals supplied from said television circuit means.

9. An apparatus according to claim 5, wherein said segment electrodes and said common electrodes of said liquid crystal display panel are arranged in a matrix fashion.

10. An apparatus according to claim 5, wherein said first analog multiplexer includes means for alternately selecting two signals from among R (Red), G (Green), and B (Blue) signals for a single pixel, and selecting the remaining one of the R, G, and B signals for a different single pixel.

11. An apparatus according to claim 5, wherein said second analog multiplexer includes means for alternately selecting two signals from among R (Red), G (Green), and B (Blue) signals for a single pixel, and selecting the remaining one of the R, G, and B signals for a different single pixel.

12. An apparatus according to claim 5, wherein said first analog multiplexer includes means to alternately perform selection of two from among R (Red), G (Green), and B (Blue) signals for a single pixel, and selection of one from among R, G, and B signals for a single pixel, and said second analog multiplexer includes means to alternately perform selection of two from among R (Red), G (Green), and B (Blue) signals for a single pixel, and selection of one from among R, G, and B signals for a single pixel, said first analog multiplexer selects two from among R, G, and B signals for a single pixel while the second analog multiplexer selects the remaining one of R, G, and B signals for the single pixel, and said first analog multiplexer selects one from among R, G, and B signals for a single pixel while said second analog multiplexer selects the remaining two from among R, G, and B signals for the single pixel.

13. An apparatus according to claim 5, wherein said first A/D converter includes means to alternately perform A/D conversion of two from among R (Red), G (Green), and B (Blue) signals for a single pixel, and A/D conversion of the remaining one of R, G, and B signals for the single pixel.

14. An apparatus according to claim 5, wherein said second A/D converter includes means to alternately perform A/D conversion of two from among R (Red), G (Green), and B (Blue) signals for a single pixel, and A/D conversion of the remaining one of R, G, and B signals for the single pixel.

15. An apparatus according to claim 5, wherein said first A/D converter includes means to alternately perform A/D conversion of two from among R (Red), G (Green), and B (Blue) signals for a single pixel, and A/D conversion of the remaining one of R, G, and B signals for the single pixel, said second A/D converter includes means to alternately perform A/D conversion of two from among R (Red), G (Green), and B (Blue) signals for a single pixel, and A/D conversion of the remaining one of R, G, and B signals for the single pixel, said first A/D converter A/D converting two from among R, G, and B signals for a single pixel while the second A/D converter A/D converts the remaining one of R, G, and B signals for the single pixel, and said first A/D converter A/D converting one from among R, G, and B signals for a single pixel while said second A/D converter converts the remaining two of R, G, and B signals for the single pixel.

16. An image display apparatus comprising:

a color liquid crystal panel having a display face surrounded by sides, a plurality of segment electrodes lying in the plane of the color liquid crystal panel, with odd-numbered segment electrodes being extracted from a different side of the color liquid crystal panel than the even-numbered segment electrodes, respective, each of said segment electrodes is assigned one of an R (Red), G (Green) and B (Blue) signal, and said segment electrodes are arranged in a sequence of any combination of R, G, B;

first and second analog multiplexers for time-divisionally mixing primary color signals of R, G, and B to be displayed on said color liquid crystal panel in an order corresponding to the segment electrodes extracted from the different sides of color liquid crystal panel, respectively;

first and second A/D converters for A/D-converting signals which are time-divisionally mixed by said first and second analog multiplexers, respectively;

first and second segment drivers for driving the segment electrodes extracted from the different sides of said color liquid crystal panel, in accordance with output signals from said first and second A/D converters, respectively; and a common driver for sequentially driving the common electrodes of said color liquid crystal panel.

17. An apparatus according to claim 16, wherein said odd-numbered segment electrodes and even-numbered segment electrodes are arranged in opposite directions and connected to said first and second segment drivers, respectively.

18. An apparatus according to claim 16, further comprising a television circuit means for receiving a television signal to drive said color liquid crystal display panel in relation thereto, said first and second A/D converters includes means for A/D converting primary color signals supplied from said television circuit means.

19. An apparatus according to claim 16, wherein said liquid crystal display panel comprises said segment electrodes and said common electrodes, said segmet electrodes and said common electrodes being arranged in a matrix fashion.

20. An image display apparatus comprising:

a color liquid crystal panel having a display face surrounded by sides, a plurality of segment electrodes lying in the plane of the color liquid crystal panel, with odd-numbered segment electrodes being extracted from a different side of the color liquid crystal panel than the even-numbered segment electrodes, respectively, each of said segment electrodes is assigned one of an R, G and B signal, and said segment electrodes are arranged in a sequence of any combination of R, G, B;

first and second analog multiplexers for time-divisionally mixing primary color signals of R, G, and B to be displayed on said color liquid crystal panel in an order corresponding to the segment electrodes extracted from the different sides of color liquid crystal panel, respectively, said analog multiplexer including means to alternately perform selection of two from among R (Red), G (Green), and B (Blue) signals for a single pixel, and selection of one from among R, G, and B signals for a single pixel, and said second analog multiplexer including means to alternately perform selection of two from among R, G, and B signals for a single pixel, and selection of one from among R, G, and B signals for a single pixel, said first analog multiplexer selecting two from among R, G, and B signals for a single pixel while the second analog multiplexer selects the remaining one of R, G, and B signals for the single pixel, and said first analog multiplexer selecting one from among R, G, and B signals for a single pixel while said second analog multiplexer selects the remaining two of R, G, and B signals for the single pixel;

first and second A/D converters for A/D-converting signals which are time-divisionally mixed by said first and second analog multiplexers, respectively;

first and second segment drivers for driving the segment electrodes extracted from the different sides of said color liquid crystal panel, in accordance with output signals from said first and second A/D converters, respectively; and a common driver for sequentially driving the common electrode of said color liquid crystal panel.

21. An apparatus according to claim 20, wherein said odd-numbered segment electrodes and even-numbered segment electrodes are arranged in opposite directions and connected to said first and second segment drivers, respectively.

22. An apparatus according to claim 20, further comprising a television circuit means for receiving a television signal to drive said color liquid crystal display panel in relation thereto, said first and said second A/D converters include means for A/D converting primary color signals supplied from said television circuit means.

23. An apparatus according to claim 20, wherein said liquid crystal display panel comprises said segment electrodes and said common electrodes, said segment electrodes and said common electrodes being arranged in a matrix fashion.

24. An image display apparatus comprising:

a color liquid crystal panel having a display face surrounded by sides, a plurality of segment electrodes lying in the plane of the color liquid crystal panel, with odd-numbered segments electrodes being extracted from a different side of the color liquid crystal panel than the even-numbered segment electrodes, respectively, each of said segment electrodes is assigned one of an R (Red), G (Green) and B (Blue) signal, and said segment electrodes are arranged in a sequence of any combination of R, G, B;

first and second analog multiplexers for time-divisionally mixing primary color signals of R, G, and B to be displayed on said color liquid crystal panel in an order corresponding to the segment electrodes extracted from the different sides of said color liquid crystal panel, respectively;

first and second A/D converters for A/D converting signals which are time-divisionally mixed by said first and second analog multiplexers, respectively, said first A/D converter including means to alternately perform A/D conversion of two from among R, G, and B signals for a single pixel, and A/D conversion of the remaining one of R, G, and B signals for the single pixel, and said second A/D converter including means to alternately perform A/D conversion of two from among R, G, and B signals for a single pixel, and A/D conversion of the remaining one of R, G, and B signals for the single pixel, said first A/D converter A/D converting two from among R, G and B signals for a single pixel while said second A/D converter converts the remaining two from among R, G, and B signals for the single pixel;

first and second segment drivers for driving the segment electrodes extracted from the different sides of said color liquid crystal panel, in accordance with output signals from said first and second A/D converters, respectively; and a common driver for sequentially driving the common electrodes of said color liquid crystal panel.

25. An apparatus according to claim 24, wherein said odd-numbered segment electrodes and even-numbered segment electrodes are arranged in opposite directions and connected to said first and second segment drivers, respectively.

26. An apparatus according to claim 24, further comprising a television circuit means for receiving a television signal to drive said color liquid crystal display panel in relation thereto, said first and second A/D converters include means for A/D converting primary color signals supplied from said television circuit means.

27. An apparatus according to claim 24, wherein said liquid crystal display panel comprises said segment electrodes and said common electrodes, said segment electrodes and said common electrodes being arranged in a matrix fashion.

* * * * *